US008154205B2

(12) United States Patent
Li

(10) Patent No.: US 8,154,205 B2
(45) Date of Patent: Apr. 10, 2012

(54) ENERGY-SAVING LED STREET LAMP AND METHOD FOR SAVING ENERGY WITH THE SAME

(76) Inventor: Xuliang Li, Dongguan (CN)

( * ) Notice: Subject to any disclaimer, the term of this patent is extended or adjusted under 35 U.S.C. 154(b) by 785 days.

(21) Appl. No.: 12/189,783

(22) Filed: Aug. 11, 2008

(65) Prior Publication Data

US 2009/0046460 A1 Feb. 19, 2009

(30) Foreign Application Priority Data

Aug. 13, 2007 (CN) ..... 2007 1 0075732

(51) Int. Cl.
*H01J 7/44* (2006.01)

(52) U.S. Cl. ..... 315/32; 315/33

(58) Field of Classification Search ..... 315/90, 315/93, 127.172, 209 R, 210, 224, 225, 291, 315/295, 297–298, 306, 307, 308, 310, 312, 315/313, 320, 323, 300, 361, 362; 362/800, 362/20, 552, 555, 559, 570, 581, 33, 85, 362/95, 227, 249, 251, 362, 372, 375, 394, 362/410, 411, 414; 313/238, 324, 357
See application file for complete search history.

(56) References Cited

U.S. PATENT DOCUMENTS

2004/0257006 A1* 12/2004 Beeman et al. ..... 315/291
2006/0226800 A1* 10/2006 Bruning ..... 318/280
* cited by examiner

*Primary Examiner* — Douglas W Owens
*Assistant Examiner* — Jianzi Chen

(57) ABSTRACT

The present invention provides an energy-saving LED street lamp and a method of saving energy with said LED street lamp. A energy-saving LED street lamp comprises lamp body, power supply adapters, constant current actuating device, and LED lamps. said constant current actuating device is connected in series with the output end of the Power supply adapter, supplying power to said LED lamps. Said energy-saving lamp also comprises auto light-dimmer energy-saving controller; the signal output end of said auto light-dimmer energy-saving controller being connected with constant current actuating device. Said LED lamps compose a plurality of working module; each of the said working module is connected with an independent Power supply adapter. Said auto light-dimmer energy-saving controller has a plurality of routes of output signal, and each of the route of signal output end is connected with a constant current actuating device, and sequentially control the lighten and extinguish time of a working module. A method of saving energy with said LED street lamp is published, too. The working time each day of LED street lamp is divided into a plurality of working time period on the basis of the measure of light used, and then different quantities of working modules are turned on in different time period controlled by the auto light-dimmer energy-saving controller on the basis of the measure of light used.

3 Claims, 8 Drawing Sheets

Section Plane A-A

Section Plane B-B

ENERGY-SAVING LED STREET LAMP AND METHOD FOR SAVING ENERGY WITH THE SAME

BACKGROUND OF THE INVENTION

1. Field of the Invention

The present invention relates to a LED lamp, particularly, to an energy-saving LED street lamp and a method of saving energy with the same.

2. Description of the Prior Art

The LED technology has been developing for some decades, while it is new technology to apply it to the illumination area. With the rapid development of LED technology and the advancement of irradiance efficiency, the application market of LED technology is more and more abroad. Under the background that the anxiety on the lack of energy on the whole world wide is hoisting, the foreground of the LED technology in the illumination area is in the attention of the whole world, and the LED technology is considered to be the most promising market in the next 10 years. LED lamp is the potential product to substitute the incandescence light, the tungsten filament light and the fluorescence light. Compare with the traditional street lamp, the LED street lamp not only has good chroma, and also has long life-span and don't need maintenance, moreover, it is more energy-saving than the traditional lamp. The design on saving energy of the existing technology is focus on the irradiance efficiency of the LED CMOS chip and lens light efficiency, but ignored the good controllability of LED lamp, and its energy-saving effect is not perfect.

SUMMARY OF THE INVENTION

The object of the present invention is to conquer the above-mentioned deficiency of the existing technology, and provide a kind of energy-saving LED street lamp and a method of saving energy with said LED street lamp.

To achieve the object, the present invention provides an energy-saving LED street lamp, comprising:

lamp body, power supply adapters, constant current actuating device, and

LED lamps;

said constant current actuating device is connected in series with the output end of the power supply adapter, supplying power to said LED lamps;

wherein said energy-saving LED street lamp also comprises auto light-dimmer energy-saving controller, a signal output end of said auto light-dimmer energy-saving controller being connected with constant current actuating device;

said LED lamps composing a plurality of working modules, each of said working module being connected with an independent power supply adapter;

said auto light-dimmer energy-saving controller comprising a plurality of routes of signal output, each route of signal output end being connected with a constant current actuating device and sequentially controlling the lighting and extinction time of a working module.

Further, an over heat thermostat is mounted between said power supply adapter and constant current actuating device.

Further, wherein said lamp body comprises head segment, middle piece and end piece;

said head segment being connected with said middle piece, the other end of said middle piece being connected with said end piece; a packing seal being mounted between said head segment and said middle piece; said head segment being connected with said middle piece with fastener;

a packing seal being mounted between said end piece and said middle piece; said end piece being connected with said middle piece with fastener;

said middle piece being a kind of section material, which has the same cross section in different positions along the length direction of the section material;

said section material comprising a basal plate; said basal plate being tabulate; said basal plate extending along the length direction of said section material; said basal plate having two sides: a right side and a wrong side;

two side plates being respectively mounted on each of the two edges of said right side; a plurality of heat dissipation wings being mounted on said wrong side;

a plurality of LED bulbs being mounted on one side of a heat conducting bottom-board, which forming LED array board, a printed circuit being mounted on said heat conducting bottom-board; the other side of said heat conducting bottom-board which has no LED bulb being cling to said right side of said basal plate of middle piece of said lamp body;

the LED street lamp also comprising a plurality of quadratic optical lens; said quadratic optical lens being mounted on a lens bottom-board with a button stand; said lens bottom-board being parallel to said LED array board; each of the said LED bulb being corresponding to one said quadratic optical lens;

there being a plurality of support units which have the same height mounted on the side of said lens bottom-board which faces to said LED array board, said support units being linked with said heat conducting bottom-board; said lens bottom-board and said heat conducting bottom-board being connected on the right side of said basal plate with fastener;

first cross member being mounted on said head segment, said first cross member being mounted on the end of said head segment which is connected with said middle piece;

second cross member being mounted on said end piece, said second cross member being mounted on the end of said end piece which is connected with said middle piece;

said first cross member, second cross member, side plates which are respectively mounted on the two edges of the right side of said middle piece, and the right side of said middle piece defining a enclosure together; the right side of said middle piece forming the bottom of said enclosure;

said first cross member, second cross member, and said two side plates which are respectively mounted on the two edges of the right side of said middle piece forming four walls of said enclosure;

a step used to place lamp-chimney being mounted on the other end of four walls of the enclosure which is far from the bottom;

a length of tube being mounted on said head segment; the axes of said tube being vertical to said first cross member;

an outlet hole which leads into said tube being mounted on said first cross member, a threaded hole which runs through the wall of said tube being mounted on the side wall of said tube; said head segment, middle piece, and end piece all being made from heat-conducting property material;

said LED street lamp also comprising lamp-chimney, said lamp-chimney being mounted on said step, packing washer being mounted between said lamp-chimney and said lamp body;

said LED array board also comprising a plurality of LED subsidiary array boards; a team of LED lamps being mounted on each of the LED subsidiary array board; each of the LED subsidiary array board being connected on the right side of said basal board of middle piece with fastener;

correspondingly, lens bottom-board also comprising a plurality of subsidiary lens bottom-boards, a team of quadratic optical lenses being mounted on each of the subsidiary lens bottom-board, each of the subsidiary lens bottom-board being connected on the right side of said basal board of middle piece with fastener;

said constant current actuating device being mounted on the end of the middle piece which is closer to the head segment of the lamp body, a heat-actuated device of a over heat thermostat being mounted on said heat conducting bottom-board.

Further, a water joint being mounted to outlet hole; said head segment being the interior sides of said two hooked side plates, which are in the hook of the side plates;

two protuberant guide plates being mounted on the side which faces to said middle piece of said second cross member; said two guide plates being mounted respectively on the interior sides of said two hooked side plates, which are in the hook of the side plates;

a plurality of foramen rotundums being mounted on said right side of said middle piece, the side which is closer to said right side of said foramen rotundum being connected to said enclosure; a plurality of protuberant heat dissipation arises being mounted on the surface of said heat dissipation wings along the length direction of said section material;

said head segment and said end piece being made from aluminium or aluminium alloy by die-casting, said middle piece being aluminium or aluminium alloy section material;

longevous LED street lamp also comprising auto light-dimmer energy-saving controller which is used to control lighting and extinction time of the lamps and the number of the working module which is lighting, said auto light-dimmer energy-saving controller and said power supply adapter being mounted on the bottom end of said LED street lamp's lampstandard.

To achieve another object, the invention provides a method for saving energy with said LED street lamp of anyone of claim 1 to 4: the working time each day of LED street lamp is divided into a plurality of working time period on the basis of the measure of light used;

and then different quantities of working modules are turned on in different time period controlled by the auto light-dimmer energy-saving controller on the basis of the measure of light used.

The present invention deals with an energy-saving LED street lamp. LED lamps comprise a plurality of working modules, each of the modules is connected with one independent constant current actuating device. Said each of the auto light-dimmer energy-saving controller has a plurality of route of signal output, each of the route of signal output is connected with a constant current actuating device, sequentially control fastened with said end piece by screw, said screw being mounted in said enclosure among said heat dissipation wings;

protuberant arris being mounted on the ektexine of said tube of said head segment, said arris being mounted along the axial direction, said threaded hole being mounted on said arris;

said side plates of said middle piece extending along the length direction of said section material, said side plates on both sides being mounted symmetrically, the cross section of said side plates being hooked, the root of said hook being mounted on the edge of said right side, the hook's needles of said two side plates being mounted vis-a-vis;

an end of said hook's needle which faces said right side comprising first plane which is parallel with said right side; second plane being mounted on the part of opposite hook's needles, which is vertical to said first plane;

said second plane being vertical to said right side; said first plane and second plane forming first arris together; said second plane and third plane forming second arris together; said third plane being parallel to said first plane; said third plane being farer from said right side than said first plane;

said third plane and forth plane forming a right angle together; said forth plane being mounted parallel to said second plane, said forth plane being farer from said hook's needle than said second plane; said third plane and said forth plane forming said step together;

said heat dissipation wings of said middle piece being slabby too; said heat dissipation wings being mounted vertical to said basal board; said heat dissipation wings extending along the length direction of said section material;

each of the heat dissipation wings being mounted parallel to each other, the first heat dissipation wing and the last heat dissipation wing being mounted respectively on the two edges of said wrong side;

two protuberant guide plates being mounted on the side which faces to said middle piece of said first cross member; said two guide plates being mounted respectively on the lighten and extinguish time of a working module, so this LED street lamp can lighten different quantity of working modules in different working time period, sequentially save energy. Contrast to prior art, the present invention make use of the character of LED street lamp that it has good controllability and good reaction speed, then achieve the object of saving energy, and achieve a better energy-saving effect than prior art do. The present invention also provides a method of saving energy with said LED street lamp, with this method different quantities of working modules are lighted in different time period on the basis of the measure of light used, it can achieve better energy-saving effect.

For the purpose of understanding the present invention easily, the embodiment of energy-saving LED street lamp and a method for saving energy for LED street lamp in present invention will be further described combining with the exploded diagram.

DETAILED DESCRIPTION OF THE INVENTION

Figure 1:
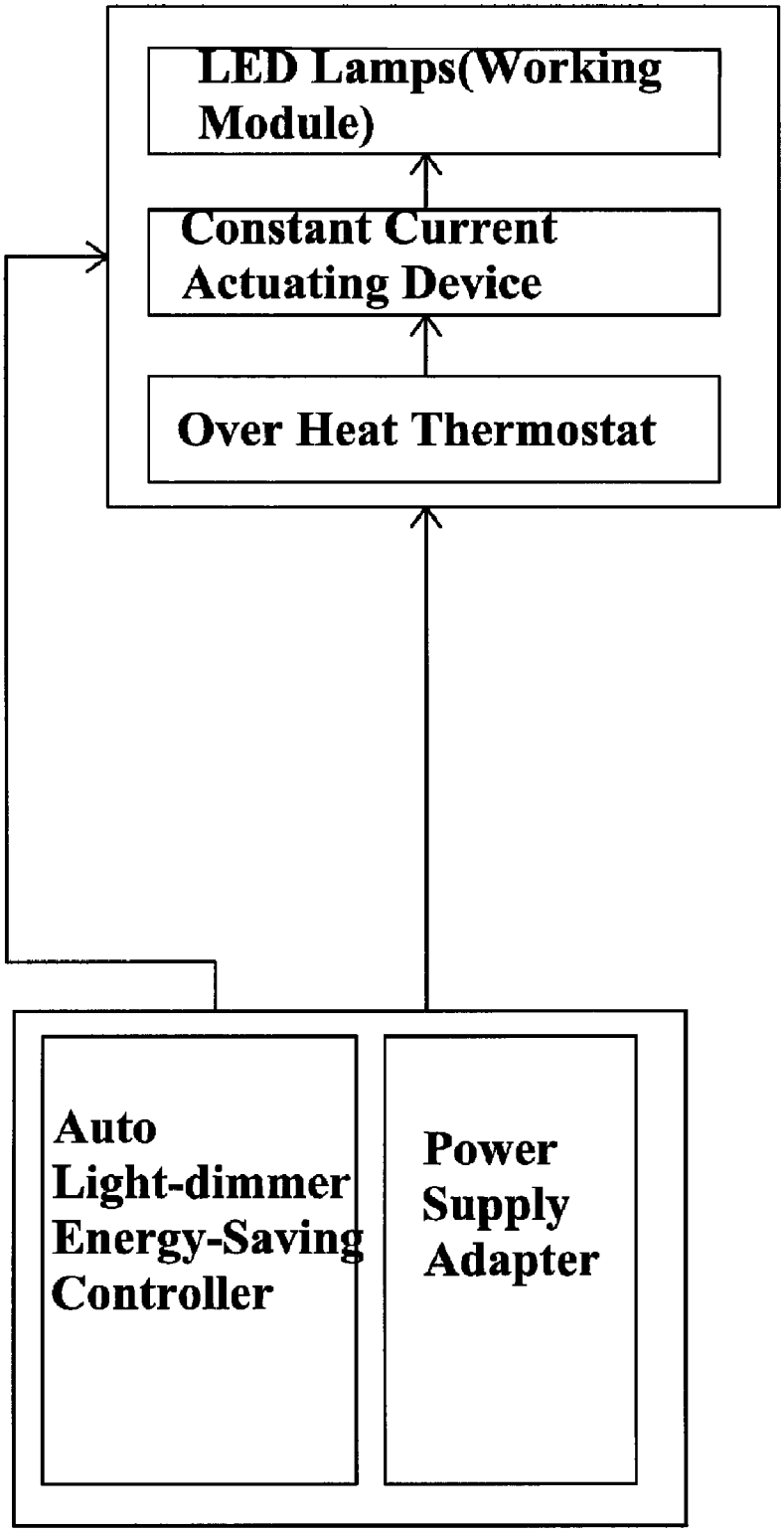
FIG. 1 is a function pane drawing of the energy-saving LED street lamp in the first embodiment of the present invention.
Figure 2:
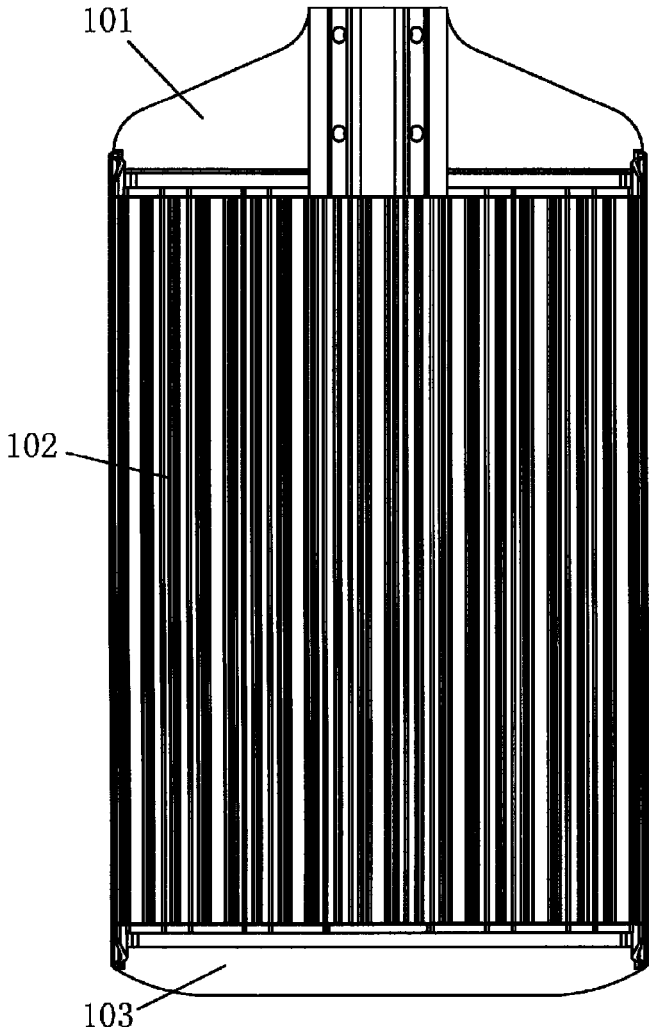
FIG. 2 is a vertical view of the energy-saving LED street lamp in the first embodiment of the present invention.
Figure 3:
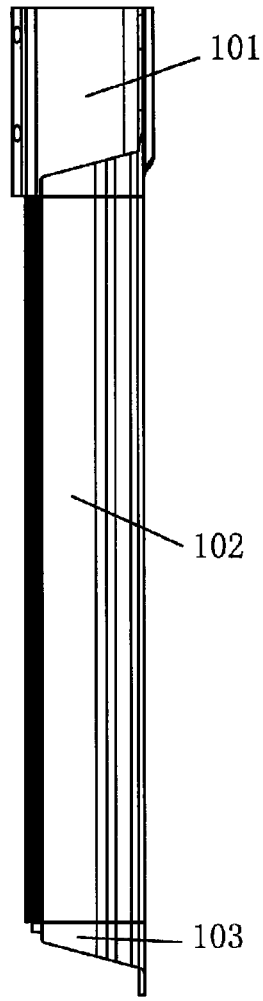
FIG. 3 is a side view of the energy-saving LED street lamp in the first embodiment of the present invention.
Figure 4:
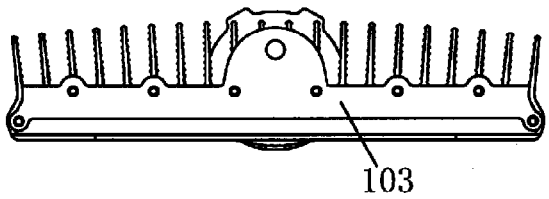
FIG. 4 is front view of the energy-saving LED street lamp in the first embodiment of the present invention.

The present invention now could be described more fully hereinafter with reference to the accompanying drawings.

The first embodiment of the present invention is a energy-saving LED street lamp, with reference to FIG. 1, FIG. 2, FIG. 3, FIG. 4, FIG. 5, FIG. 6, FIG. 7, FIG. 8, FIG. 9, FIG. 10, FIG. 11, the LED street lamp 100 consists of lamp body and LED bulb 107, the lamp body comprises of head segment 101, middle piece 102, end piece 103. Said head segment 101 is connected with said middle piece 102, the other end of the middle piece 102 is connected with said end piece 103. A packing seal 104 is mounted between said head segment 101 and said middle piece 102, said head segment 101 is connected with said middle piece 102 with screw. A packing seal 105 is mounted between said end piece 103 and said middle piece 102, said end piece 103 is connected with said middle piece 102 with screw. Said middle piece 102 is a kind of section material, it has the same cross section in the different positions along the length direction of the section material. Said section material comprises of a basal plate, said basal plate is tabulate, said basal plate extends along the direction of the length of said section material. Said basal plate has two sides: the right side and the wrong side; two side plates are respectively mounted on each of the two edges of said right side, there are some heat dissipation wing 1021 mounted on said wrong side.

LED bulb 107 is mounted on a side of said heat conducting bottom-board 106, which form LED array board, a printed circuit is mounted on said heat conducting bottom-board 106. The other side of said heat conducting bottom-board 106 which has no LED bulb is cling to said right side of said basal plate of middle piece of said lamp body. The LED street lamp comprises quadratic optical lens 109, said quadratic optical lens 109 is mounted on said lens bottom-board 108 with button stand, said lens bottom-board 108 is parallel to LED array board, each of the said LED bulb 107 is corresponding to one said quadratic optical lens 109. There are some support units which have the same height mounted on the side of said lens bottom-board 108 which faces to LED array board. Said support units are cylinder in this embodiment, there is a through hole mounted in the hub of said cylinder, there is also a hole on the part of said heat conducting bottom-board which is opposite to the hole of said cylinder, the above-mentioned two holes are used for setting the screw. There is a counter-bore mounted on the part which is opposite to said support unit of the other side of said lens bottom-board, it is used for immersing the head of the screw. Said support units are withstand said heat conducting bottom-board 106, said lens bottom-board 108 and said heat conducting bottom-board 106 is connected on the right side of said basal plate with the screw.

Figure 5:
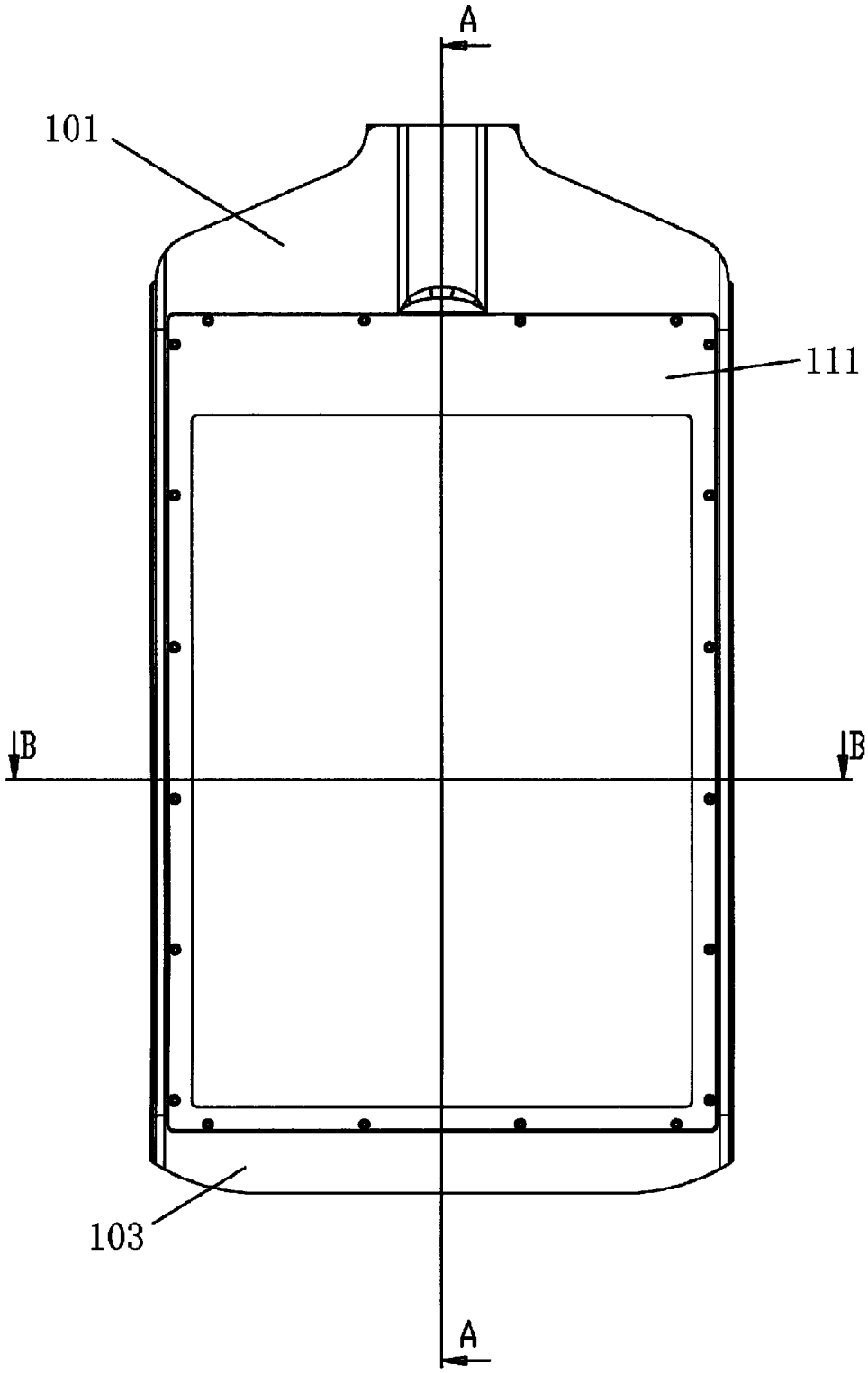
FIG. 5 is bottom view of the energy-saving LED street lamp in the first embodiment of the present invention.
Figure 6:
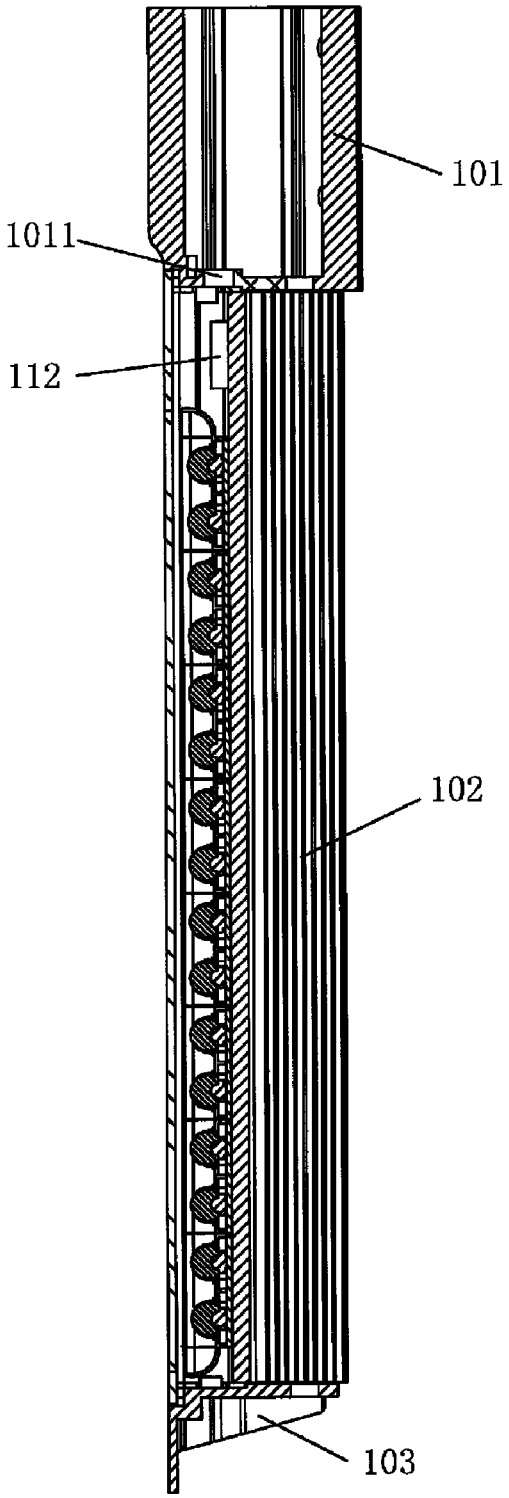
FIG. 6 is A-A sectional view of FIG. 4.
Figure 7:
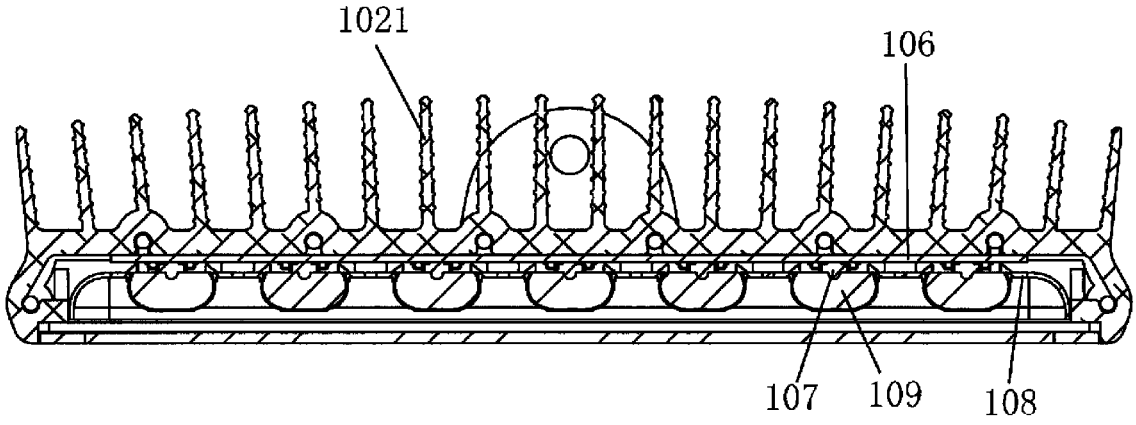
FIG. 7 is B-B sectional view of FIG. 4.
Figure 8:
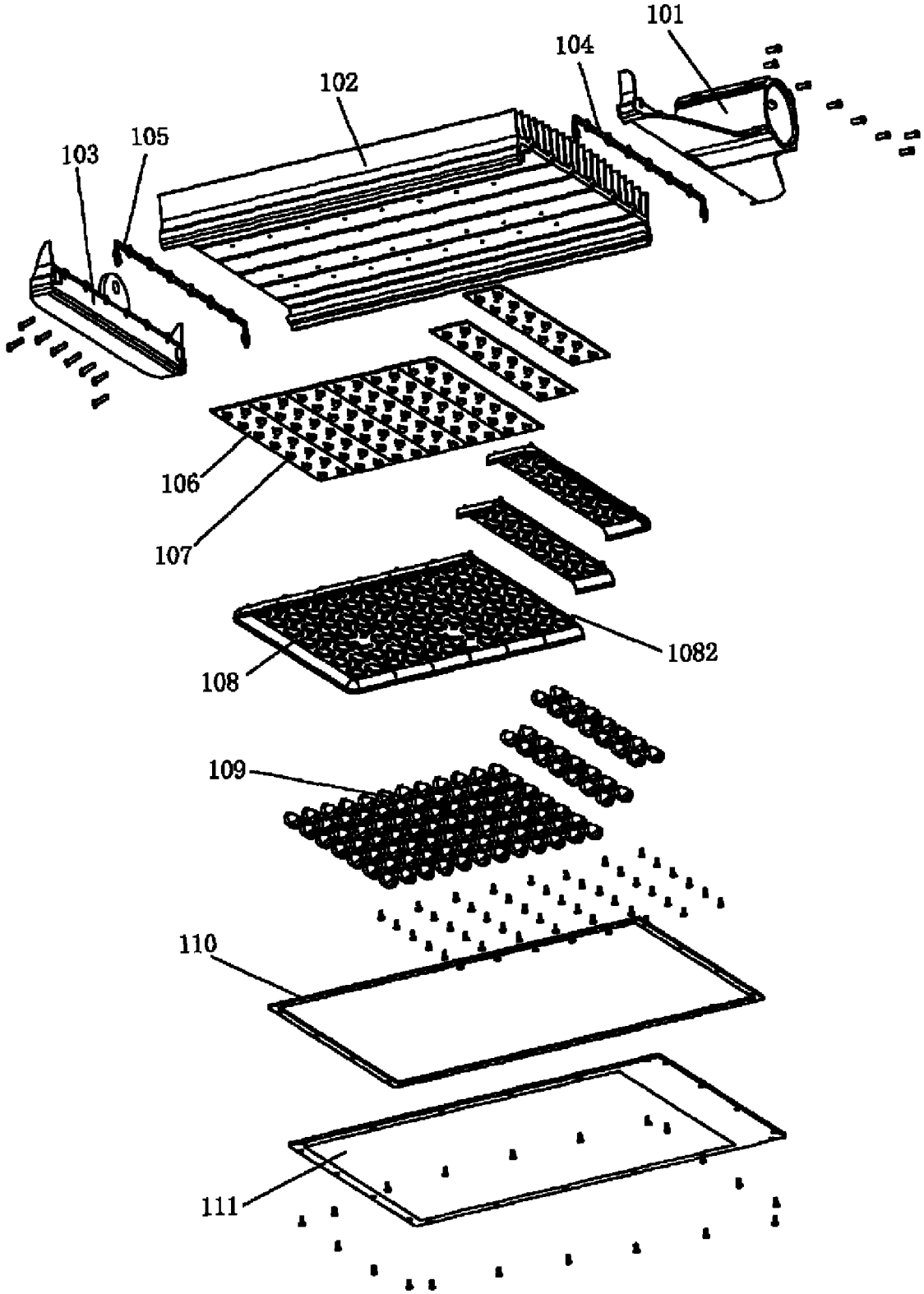
FIG. 8 is dissection sketch map of the energy-saving LED street lamp in the first embodiment of the present invention.
Figure 9:
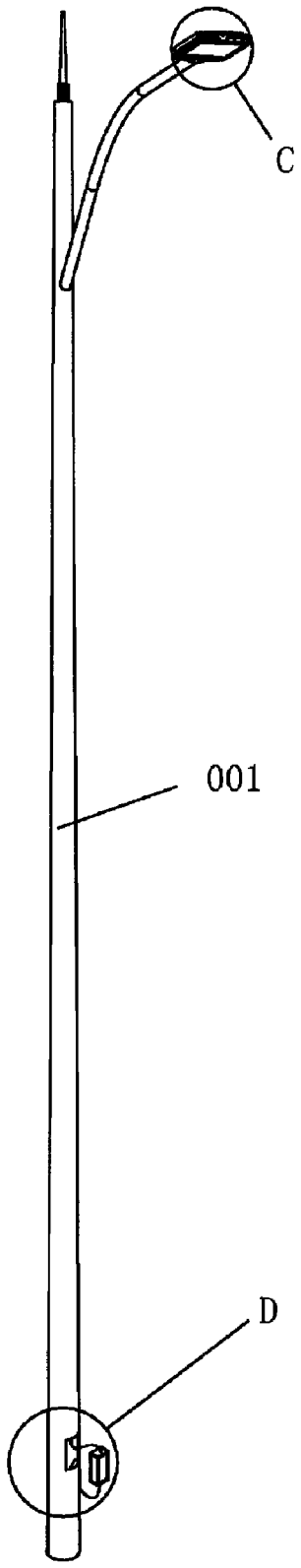
FIG. 9 is the sketch map of the energy-saving LED street lamp fixed on the lamp standard.
Figure 10:
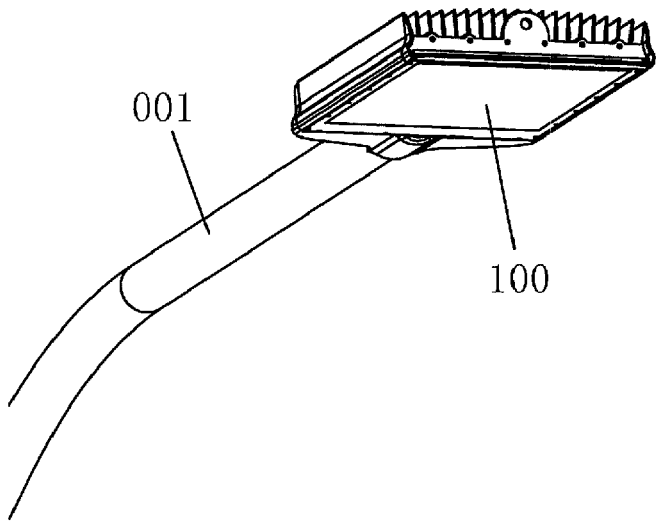
FIG. 10 is partial enlarged drawing of part C of FIG. 9.
Figure 11:
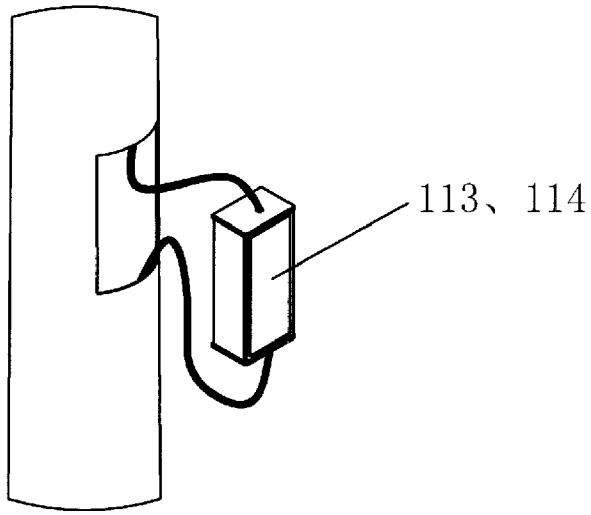
FIG. 11 is partial enlarged drawing of part D of FIG. 9.

First cross member is mounted on said head segment 101, said first beam is mounted on the end of said head segment 101 of said bomb body which is withstand with said middle piece 102. Second cross member is mounted on the end piece 103, said second cross member is mounted on the end on said end piece 103 of said bomb body which is withstand with said middle piece 102. Said first cross member, second cross member, side plates which are respectively on the two edges of the right side of said middle piece 102, and the right side of said middle piece 102 define a enclosure together. The right side of said middle piece 102 form the bottom of said enclosure, said first cross member, second cross member, and said two side plates which are respectively mounted on the two edges of the right side of said middle piece 102 form the four walls of said enclosure. A step used to place lamp-chimney 111 is mounted on the other end of the four walls of the enclosure which is far from the bottom. A length of tube is mounted on said head segment 102, the axes of said tube is vertical to said first cross member. Refer to FIG. 5, an outlet hole 1011 leading into said tube is mounted on said first cross member, a threaded hole running through the tube wall is mounted on the side wall of said tube, which is used to lock the LED street lamp on the lampstandard. In this embodiment, protuberant arris is mounted on the ektexine of said tube, said arris is mounted along the axial direction, said threaded hole is mounted on said arris. Said head segment 101, middle piece 102 and end piece 103 are all aluminum which has good heat-conducting property.

Said LED street lamp also comprises lamp-chimney 111, said lamp-chimney 111 is mounted on said step, packing washer 110 is mounted between said lamp-chimney 111 and lamp body. LED array board comprises a plurality of LED subsidiary array board, a team of LED lamps are mounted on each of the LED subsidiary array board, each of the LED subsidiary array board is connected on the right side of said basal board of middle piece 102 with screw. The LED lamps which are mounted on each of the LED subsidiary array board compose one LED working module. Correspondingly, lens bottom-board 108 also comprises of a plurality of subsidiary lens bottom-board, a team of quadratic optical lenses is mounted on each of the subsidiary lens bottom-board, each of the subsidiary lens bottom-board is connected on the right side of said basal board of middle piece 102 with screw.

LED street lamp also comprises of constant current actuating device, said constant current actuating device is mounted in the close enclosure formed by the lamp body and lamp-chimney 111. A plurality of teams of unattended constant current actuating devices 112 are mounted on the end which is closer to said head segment 101. The output end of each of the constant current actuating device is connected with the corresponding LED subsidiary array board by the lead, said constant current actuating device is used to supply power for the corresponding LED working module. Said all teams of constant current actuating device have a common input end, said input end is connected to power supply adapter by the lead. Said constant current actuating device is mounted on the end of middle piece of the lamp body which is closer to the head segment, said heat-actuated device of the over heat thermostat is mounted on the heat conducting bottom-board.

In this embodiment, the LED lamps of each of the LED working module are shunt-wound, the working voltage of the module is 48V, the power of single LED lamp is 1 W. Of course, the LED lamps of the LED working module can also be series-wound or in other connection type for its own needs. The working voltage of the module can also be 36V or 220V, and so on.

In this embodiment, a water joint is mounted to outlet hole 1011, in order to ensure that the inside of said enclosure is dry. In this embodiment, said side plates of said middle piece 102 of said lamp body extend along the length direction of said section material, said side plates on both sides are mounted symmetrically. The cross section of said side plates is hooked, the root of said hook is mounted on the edge of said right side, the hook's needle of the two side plates are opposite. An end of the hook's needle which faces said right side have first plane which is parallel with said right side, second plane is mounted on the opposite part of hook's needle, which is vertical to first plane. Said second plane is vertical to said right plane, said first plane and second plane form the first arris together, said second plane and third plane form the second arris together. Said third plane is parallel to said first plane; said third plane is farer from said right side than said first plane. Said third plane and forth plane form a right angle together; said forth plane is mounted parallel to said second plane; said forth plane is farer from said hook's needle than said second plane; said third plane and said forth plane form said step together.

Said heat dissipation wings 1021 of said middle piece 102 are slabby too, said heat dissipation wings 1021 are mounted vertical to said basal board, said heat dissipation wings 1021 extend along the length direction of said section material. Each of the heat dissipation wing 1021 is mounted parallel to each other, said each of the heat dissipation wing 1021 may also be mounted approximate parallel, or be mounted slightly radially. The first heat dissipation wing and the last dissipation wing are mounted respectively on the two edges of said wrong side. In this embodiment, a plurality of protuberant heat dissipation arris are mounted on the surface of said heat dissipation wings along the length direction of said section material. Two guide plates are mounted on the side which is face to said middle piece 102 of said first cross member, said two guide plates are mounted respectively on the interior of said hooked side plates, which is in the hook of the side plate.

Two protuberant guide plates are mounted on the side which is face to said middle piece 102 of said second cross member, said two guide plates are mounted respectively on the interior of said hooked side plates, which is in the hook of the side plate. A plurality of foramen rotundums are mounted on the right side of said middle piece 102, the side of said foramen rotundum which is closer to said right side is connected to said enclosure. Said foramen rotundums are used as the thread bottom hole when said head segment 101 or said end piece 103 is connected with said middle piece 102. When in use, the LED street lamp 110 of this invention is fixed on the lampstandard 001 via said tube of said head segment 101. Power line is lay in the lampstandard, which is connected with said Power supply adapter which is on the bottom of said lampstandard.

FIG. 1 is the function pane drawing of this embodiment, thereinto power supply adapter 114 and auto light-dimmer energy-saving controller 113 are mounted on the bottom of said LED lamp's lampstandard. Refer to FIG. 1, power supply adapter 114 and auto light-dimmer energy-saving controller 113 are mounted in a control cabinet which is on the bottom of said lampstandard, said LED lamp, said constant current actuating device 112, and said over heat thermostat are mounted in the lamp body which is on the upward of the LED lamp's lampstandard. The LED lamp teams on each of the LED array board form a working module, each of the working module is connected with a independent constant current actuating device 112. Said over heat thermostat is connected in series between the input end of said constant current actuating device 112 and power supply adapter 114, the output end of said constant current actuating device 112 is connected with the working module formed by LED lamps. The signal output end of said auto light-dimmer energy-saving controller 113 is connected with said constant current actuating device 112. Auto light-dimmer energy-saving controller 113 have a plurality of routes of signal output, which is square signal whose duty cycle is tunable, each of the route signal output end is connected with a constant current actuating device 112, thereby control the lighten and extinct time of a said working module.

The second embodiment of this invention is a method of saving energy with said LED street lamp, the energy-saving LED street lamp involved in the first embodiment of this invention is used. Said auto light-dimmer energy-saving controller is mounted in the way thereafter, six tap positions are mounted: 0, 1, 2, 3, 4, 5. Respectively, the lamps of all working module are turned on at the beginning, 4 hours later or 4.5 hours later or 5 hours later or 5.5 hours later or 6 hours later or 6.5 hours later, half of said LED working module work considering the practical situation of different area, cycle operation like this. In this embodiment, a LED working module charge balance program is added, which is used to balance the charge of said LED working module.

The third embodiment of this invention is a method of saving energy with said LED street lamp, the energy-saving LED street lamp involved in the first embodiment of this invention is used. Said auto light-dimmer energy-saving controller is mounted in the way thereafter, all the working modules work in the first 4 hours after turning on the LED street lamp, in the next 3 hours, half of the working modules work; in another next 3 hours, a quarter of the working modules work. A LED working module charge balance program is mounted in the auto light-dimmer energy-saving controller, which is used to balance the working charge of the LED working module in the period that not all the working module is working. When some time period is set to half brighten, this period is average divided into two subsidiary periods, on entering in the second subsidiary period, the LED working modules which was brighten are turned off, and the another team LED working module are turned on. In like manner, when the time period is set to that a quarter of the LED working modules work, said time period is average divided into four subsidiary periods, said four subsidiary periods are supplied to four parts LED working modules brighten alternately, sequentially balance the working charge of LED lamps.

What is claimed is:

1. An energy-saving LED street lamp, comprising:

lamp body, power supply adapters, constant current actuating device, and

LED lamps;

said constant current actuating device is connected in series with the output end of the power supply adapter, supplying power to said LED lamps;

wherein said energy-saving LED street lamp also comprises auto light-dimmer energy-saving controller, a signal output end of said auto light-dimmer energy-saving controller being connected with constant current actuating device;

said LED lamps composing a plurality of working modules, each of said working module being connected with an independent power supply adapter;

said auto light-dimmer energy-saving controller comprising a plurality of routes of signal output, each route of signal output end being connected with a constant current actuating device and sequentially controlling the lighting and extinction time of a working module;

wherein said lamp body comprises head segment, middle piece and end piece;

said head segment being connected with said middle piece, the other end of said middle piece being connected with said end piece; a packing seal being mounted between said head segment and said middle piece; said head segment being connected with said middle piece with fastener;

a packing seal being mounted between said end piece and said middle piece; said end piece being connected with said middle piece with fastener;

said middle piece being a kind of section material, which has the same cross section in different positions along the length direction of the section material;

said section material comprising a basal plate; said basal plate being tabulate; said basal plate extending along the length direction of said section material; said basal plate having two sides: a right side and a wrong side;

two side plates being respectively mounted on each of the two edges of said right side; a plurality of heat dissipation wings being mounted on said wrong side;

a plurality of LED bulbs being mounted on one side of a heat conducting bottom-board, which forming LED array board, a printed circuit being mounted on said heat conducting bottom-board; the other side of said heat conducting bottom-board which has no LED bulb being cling to said right side of said basal plate of middle piece of said lamp body;

the LED street lamp also comprising a plurality of quadratic optical lens; said quadratic optical lens being mounted on a lens bottom-board with a button stand; said lens bottom-board being parallel to said LED array board; each of the said LED bulb being corresponding to one said quadratic optical lens;

there being a plurality of support units which have the same height mounted on the side of said lens bottom-board which faces to said LED array board, said support units being linked with said heat conducting bottom-board; said lens bottom-board and said heat conducting bottom-board being connected on the right side of said basal plate with fastener;

first cross member being mounted on said head segment, said first cross member being mounted on the end of said head segment which is connected with said middle piece;

second cross member being mounted on said end piece, said second cross member being mounted on the end of said end piece which is connected with said middle piece;

said first cross member, second cross member, side plates which are respectively mounted on the two edges of the right side of said middle piece, and the right side of said middle piece defining a enclosure together; the right side of said middle piece forming the bottom of said enclosure;

said first cross member, second cross member, and said two side plates which are respectively mounted on the two edges of the right side of said middle piece forming four walls of said enclosure;

a step used to place lamp-chimney being mounted on the other end of four walls of the enclosure which is far from the bottom;

a length of tube being mounted on said head segment; the axes of said tube being vertical to said first cross member;

an outlet hole which leads into said tube being mounted on said first cross member, a threaded hole which runs through the wall of said tube being mounted on the side wall of said tube; said head segment, middle piece, and end piece all being made from heat-conducting property material;

said LED street lamp also comprising lamp-chimney, said lamp-chimney being mounted on said step, packing washer being mounted between said lamp-chimney and said lamp body;

said LED array board also comprising a plurality of LED subsidiary array boards; a team of LED lamps being mounted on each of the LED subsidiary array board; each of the LED subsidiary array board being connected on the right side of said basal board of middle piece with fastener;

correspondingly, lens bottom-board also comprising a plurality of subsidiary lens bottom-boards, a team of quadratic optical lenses being mounted on each of the subsidiary lens bottom-board, each of the subsidiary lens bottom-board being connected on the right side of said basal board of middle piece with fastener;

said constant current actuating device being mounted on the end of the middle piece which is closer to the head segment of the lamp body, a heat-actuated device of an over heat thermostat being mounted on said heat conducting bottom-board.

2. The energy-saving LED street lamp of claim 1, wherein an over heat thermostat is mounted between said power supply adapter and constant current actuating device.

3. The energy-saving LED street lamp of claim 1, wherein a water joint being mounted to outlet hole; said head segment being fastened with said end piece by screw, said screw being mounted in said enclosure among said heat dissipation wings;

protuberant arris being mounted on the ektexine of said tube of said head segment, said arris being mounted along the axial direction, said threaded hole being mounted on said arris;

said side plates of said middle piece extending along the length direction of said section material, said side plates on both sides being mounted symmetrically, the cross section of said side plates being hooked, the root of said hook being mounted on the edge of said right side, the hook' s needles of said two side plates being mounted vis-a-vis;

an end of said hook' s needle which faces said right side comprising first plane which is parallel with said right side; second plane being mounted on the part of opposite hook' s needles, which is vertical to said first plane;

said second plane being vertical to said right side; said first plane and second plane forming first arris together; said second plane and third plane forming second arris together; said third plane being parallel to said first plane; said third plane being farer from said right side than said first plane;

said third plane and forth plane forming a right angle together; said forth plane being mounted parallel to said second plane, said forth plane being farer from said hook' s needle than said second plane; said third plane and said forth plane forming said step together;

said heat dissipation wings of said middle piece being slabby too; said heat dissipation wings being mounted vertical to said basal board; said heat dissipation wings extending along the length direction of said section material;

each of the heat dissipation wings being mounted parallel to each other, the first heat dissipation wing and the last heat dissipation wing being mounted respectively on the two edges of said wrong side; two protuberant guide plates being mounted on the side which faces to said middle piece of said first cross member; said two guide plates being mounted respectively on the interior sides of said two hooked side plates, which are in the hook of the side plates; two protuberant guide plates being mounted on the side which faces to said middle piece of said second cross member; said two guide plates being mounted respectively on the interior sides of said two hooked side plates, which are in the hook of the side plates; a plurality of foramen rotundums being mounted on said right side of said middle piece, the side which is closer to said right side of said foramen rotundum being connected to said enclosure; a plurality of protuberant heat dissipation arrises being mounted on the surface of said heat dissipation wings along the length direction of said section material;

said head segment and said end piece being made from aluminium or aluminium alloy by die-casting, said middle piece being aluminium or aluminium alloy section material;

longevous LED street lamp also comprising auto light-dimmer energy-saving controller which is used to control lighting and extinction time of the lamps and the number of the working module which is lighting, said auto light-dimmer energy-saving controller and said power supply adapter being mounted on the bottom end of said LED street lamp's lampstandard.

* * * * *